US005205255A

United States Patent [19]

Yamagata et al.

[11] Patent Number: 5,205,255

[45] Date of Patent: Apr. 27, 1993

[54] STARTING TIME ENGINE SPEED CONTROL DEVICE

[75] Inventors: Takashi Yamagata; Hiroyuki Shimase, both of Hamamatsu; Mitsuru Miyata; Tomoyuki Hirose, both of Isesaki, all of Japan

[73] Assignees: Suzuki Motor Corporation, Shizuoka; Japan Electronic Control Systems Co., Ltd., Gunma, both of Japan

[21] Appl. No.: 798,509

[22] Filed: Nov. 26, 1991

[30] Foreign Application Priority Data

Nov. 26, 1990 [JP] Japan ..... 2-321666
Nov. 26, 1990 [JP] Japan ..... 2-321669

[51] Int. Cl.[5] ..... F02D 41/06

[52] U.S. Cl. ..... 123/331; 123/491

[58] Field of Search ..... 123/491, 330, 331, 179.16

[56] References Cited

U.S. PATENT DOCUMENTS 4,336,778 6/1982 Howard ..... 123/334
4,610,231 9/1986 Nakata et al. ..... 123/424
4,630,590 12/1986 Kondo et al. ..... 123/418 X
4,648,371 3/1987 Kaneta ..... 123/492
4,681,079 7/1987 Kaneta ..... 123/491
5,050,564 9/1991 Suzuki et al. ..... 123/492

FOREIGN PATENT DOCUMENTS 30940 2/1990 Japan .

*Primary Examiner*—Tony M. Argenbright
*Attorney, Agent, or Firm*—Flynn, Thiel, Boutell & Tanis

[57] ABSTRACT

A starting time engine speed control device is provided for controlling fuel to be injected by correcting an amount thereof within a predetermined period of time after the start of an internal combustion engine using a starting time fuel injection control with respect to a basic fuel control. The engine is mounted on a vehicle and has a clutch mechanism which is coupled when engine speed exceeds a coupling engine speed, and the starting time engine speed control device includes a control arrangement adapted to control the fuel to be injected by gradually increasingly correcting the amount thereof in accordance with increasing engine speed up to said coupling engine speed using the starting time fuel injection control.

2 Claims, 6 Drawing Sheets

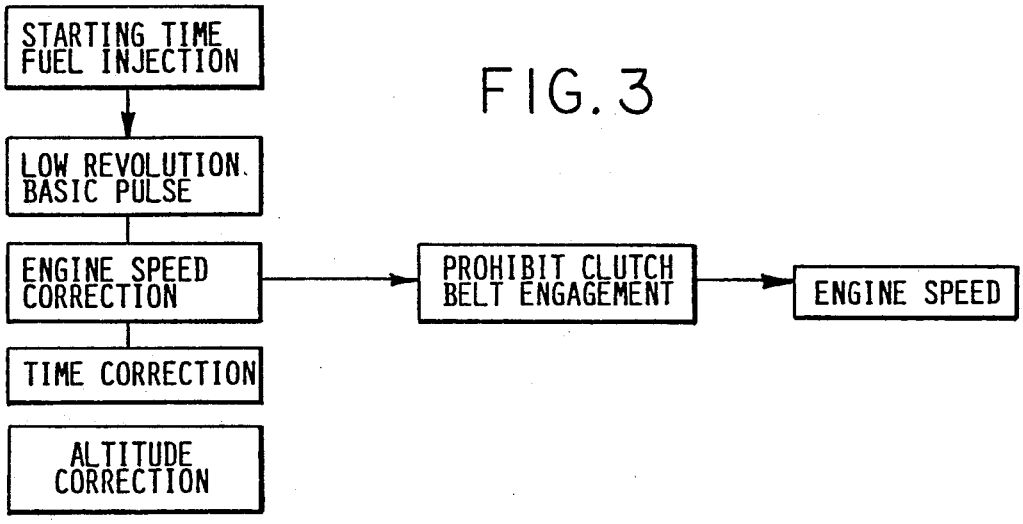
FIG. 3
FIG. 4
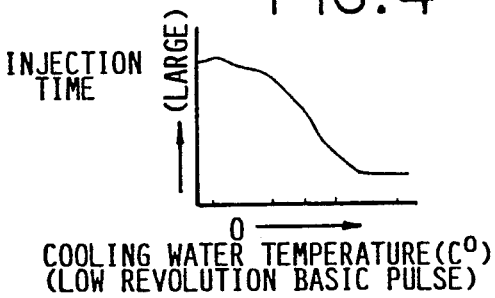
FIG. 5
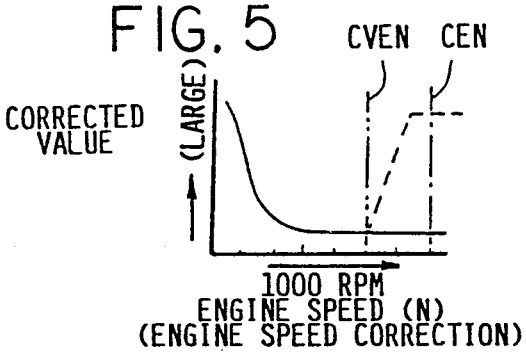
FIG. 6
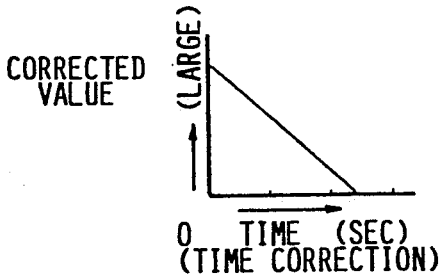
FIG. 7
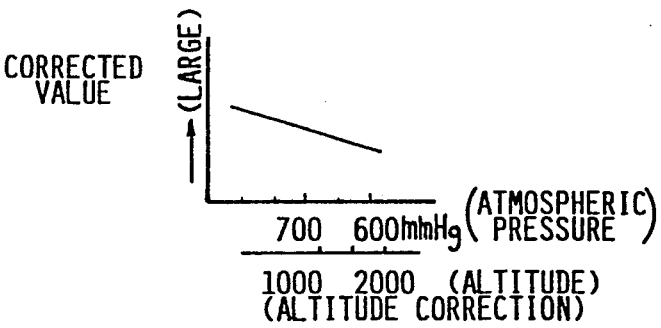

STARTING TIME ENGINE SPEED CONTROL DEVICE

FIELD OF THE INVENTION

This invention relates to a starting time engine speed control device for an engine having a clutch mechanism which is coupled when engine speed exceeds a coupling engine speed, and particularly to a starting time engine speed control device capable of preventing a meaning less increase of engine speed when fuel to be injected is controlled by correcting an amount thereof, with respect to a basic fuel injection control, by means of a starting time fuel injection control.

The present invention also relates to a starting time engine speed control device capable of obviating awkwardness of a driving state of a vehicle due to improper air-fuel ratio when the vehicle is immediately started after the start of the internal combustion engine.

BACKGROUND OF THE INVENTION

Among various internal combustion engines to be mounted on a vehicle, there is one which has a clutch mechanism which is coupled when engine speed exceeds a coupling engine speed. Similarly, among various devices for injecting fuel to an internal combustion engine of the type mentioned above, there is one which includes a starting time engine speed control device for controlling fuel to be injected by correcting an amount thereof, with respect to a basic fuel injection control, within a predetermined period of time from the start of the internal combustion engine by means of starting time fuel injection control.

One starting time engine speed control device of the type mentioned above is disclosed in Japanese Patent Early Laid-open Publication No. Hei 2-30940. In the device disclosed by this publication, when fuel is injected in an increased amount decided in accordance with a cooling temperature at the starting time of an internal combustion engine, if engine speed is increased at the starting time of the internal combustion engine, fuel is injected by decreasingly correcting the amount of fuel in accordance with engine speed, and if engine speed is decreased at the starting time of the internal combustion engine, the increasing correction of the amount of fuel is prohibited.

It sometimes happens that engine speed is meaningless increased in spite of the fact that the throttle valve is in an idle position, when fuel to be injected is controlled such that an amount thereof is corrected, with respect to a basic fuel injection control, within a predetermined period of time from the starting time of the internal combustion engine by means of a starting time fuel injection control.

In the event as mentioned above, it sometimes gives rise to a problem that in the aforementioned internal combustion engine which is mounted on a vehicle and which has a clutch mechanism which is coupled when engine speed exceeds a coupling engine speed, the clutch is coupled when the increasing engine speed has exceeded the coupling engine speed, and as a result, a driving force of the internal combustion engine is transmitted to a driving mechanism. Furthermore, it sometimes gives rise to another problem that the clutch mechanism is coupled when the engine speed is increased exceeding the coupling engine speed by a drivers adjustment of an idle adjusting screw of the internal combustion engine in order to set the idle speed to an increased level, with the result that a driving force of the internal combustion engine is transmitted to the driving mechanism.

Therefore, it can be considered that by controlling fuel to be injected in such a manner as to increasingly correct an amount thereof by means of starting time fuel injection control in accordance with an increasing engine speed up to a coupling engine speed when fuel is injected by correcting the amount thereof by means of a starting time fuel injection control, the air-fuel ratio is intensified to reduce engine output and to lower the engine speed thereby preventing coupling of the clutch mechanism.

When fuel to be injected is controlled by gradually increasingly correcting an amount thereof at the starting time of an internal combustion engine as mentioned above, removal of this correction of engine speed is managed by time correction. Therefore, the gradual increasing correction of the amount of fuel by means of the engine speed correction is continued until the passage of a preset time which has been preset by the time correction.

Such being the case, when a driver attempts to drive a vehicle immediately after the start of the internal combustion engine, the driver encounters inconveniences in that the air-fuel ratio becomes improper due to intensified air-fuel ratio in the speed area of the gradual increasing correction of the amount of fuel, and the engine output is reduced to prevent increase of the engine speed, with the result that the vehicle drives awkwardly.

The above-mentioned awkward driving state is disadvantageous for vehicles of the type which are required to start driving, immediately after the start of the internal combustion engine, such as snowmobiles, etc.

It is therefore a first object of the present invention to provide a starting time engine speed control device for an engine having a clutch mechanism which is coupled when engine speed exceeds a coupling engine speed capable of preventing a meaningless increase of engine speed when fuel to be injected is controlled by correcting an amount thereof, with respect to a basic fuel injection control, by means of starting time fuel injection control.

A second object of the present invention is to realize a starting time engine speed control device capable of obviating awkward driving states due to improper air-fuel ratio when the vehicle is immediately started after the start of the internal combustion engine.

In order to achieve the first object, the present invention is characterized by a starting time engine speed control device for controlling fuel to be injected by correcting an amount thereof, with respect to a basic fuel injection control, within a predetermined period of time after the start of engine by means of starting time fuel injection control, wherein said starting time engine speed control device includes control means adapted to control the fuel to be injected by gradually increasingly correcting the amount thereof in accordance with increasing engine speed up to said coupling engine speed.

Similarly, in order to achieve the second object, the present invention is characterized by a starting speed control device for controlling fuel to be injected by correcting an amount thereof, with respect to a basic fuel injection control, within a predetermined period of time after the start of engine by means of starting time fuel injection control, wherein said starting time engine speed control device includes control means adapted to control the fuel to be injected by gradually increasingly correcting the amount thereof in accordance with an increasing state of the engine speed up to said coupling engine speed, said control means being further able to control such that when a throttle opening degree is equal to or more than a preset throttle opening degree and engine speed is equal to or higher than a preset level, the mode of controlling is shifted from said starting time fuel injection control to said basic fuel injection control and said amount of fuel decided by said basic fuel injection control is injected.

According to one embodiment of the invention, by letting the control means control fuel to be injected in such a manner as to increasingly correct an amount thereof by means of starting time fuel injection control in accordance with increasing engine speed up to the coupling engine speed, the air-fuel ratio is intensified to reduce engine output and to lower the engine speed thereby prohibiting coupling of the clutch mechanism.

According to another embodiment, by letting the control means control such that when the throttle valve is opened to the extent equal to or more than a preset throttle opening degree and the engine speed is at a level equal to or higher than a preset engine speed, the vehicle can start driving immediately after the start of the internal combustion engine, because the mode of controlling is shifted from the starting time fuel injection control to the basic fuel injection control and there can be obtained an engine output required for a driving of the vehicle by a proper air-fuel ratio, by injecting the amount of fuel decided by this basic fuel injection control.

BRIEF DESCRIPTION OF THE DRAWINGS

The embodiments of the present invention will be described in detail with reference to the drawings, in which

FIG. 3 is a block diagram of controlling operation;

FIG. 4 is an explanatory view of a low revolution basic pulse of starting time fuel injection control;

FIG. 5 is an explanatory view of an engine speed correction of the starting time fuel injection control;

FIG. 6 is an explanatory view of the time correction of the starting time fuel injection control;

FIG. 7 is an explanatory view of an altitude correction of the starting time fuel injection control;

DETAILED DESCRIPTION

Figure 1:
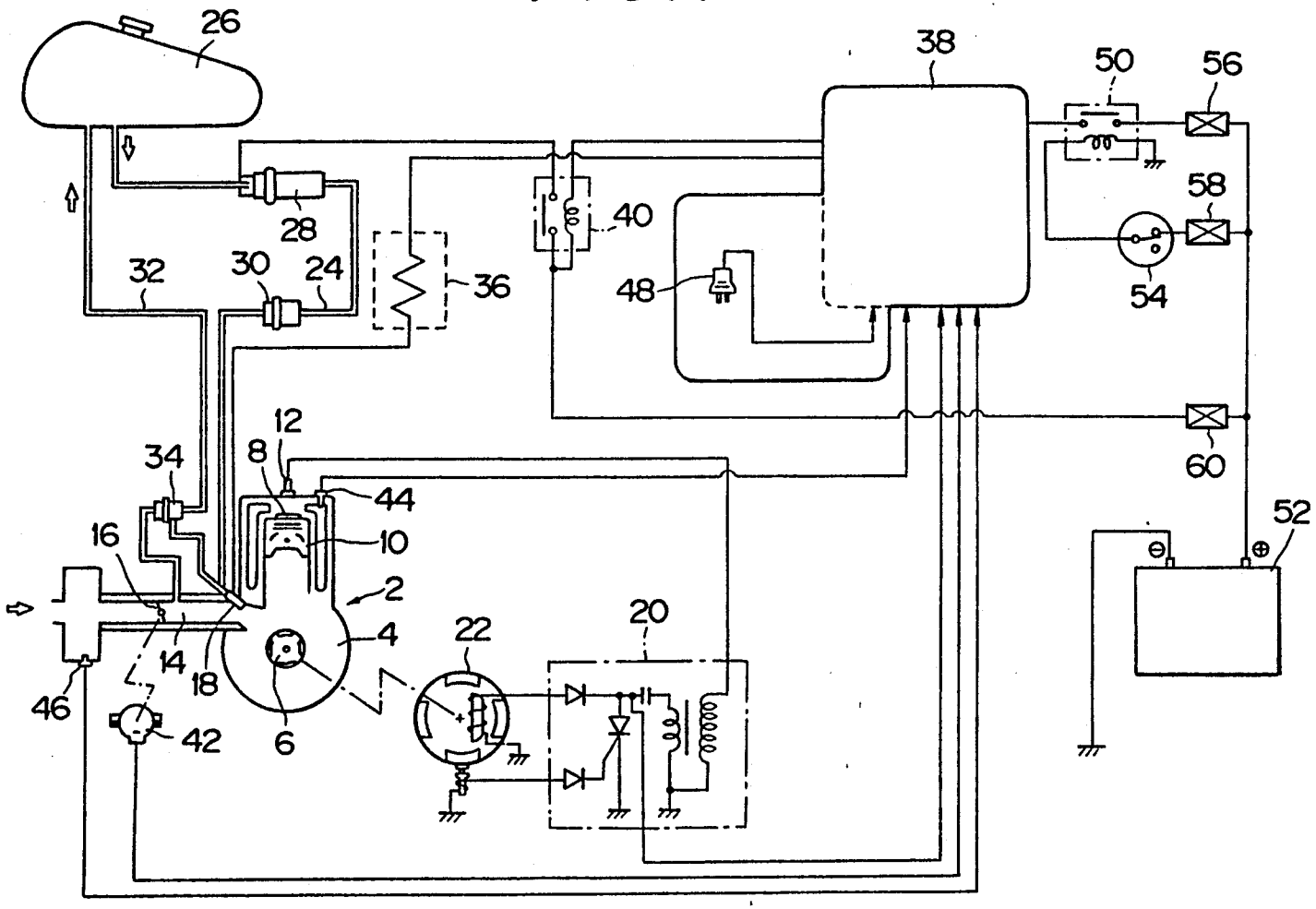
FIG. 1 is a view schematically showing the constitution of a starting time engine speed control device of the present invention.

FIGS. 1 through 7 show one embodiment of a starting time engine speed control device according to the invention. In FIG. 1, the numeral 2 denotes an internal combustion engine, 4 a crank chamber, 6 a crank shaft, 8 a combustion chamber, 10 a piston, and 12 an ignition plug, respectively. The internal combustion engine 2 in this embodiment is a two-cycle internal combustion engine which makes two strokes comprising an air scavenging and compressing stroke and an air compressing and intaking stroke during the time the crank shaft 6 makes one rotation, the two strokes constituting one cycle. This internal combustion engine 2 is mounted on a vehicle (not shown) and has a clutch mechanism (for example, centrifugal automatic start clutch, or the like) which is coupled when engine speed exceeds a coupling engine speed.

The crank chamber 4 of the internal combustion chamber 2 is communicated with an inlet passage 14. The inlet passage 14 is provided with a throttle valve 16 and also with a fuel injection valve 18. The ignition plug 12 disposed in the combustion chamber 8 is connected to an ignition circuit 20. The ignition circuit 20 sparks the ignition plug 12 in accordance with a signal input from a pickup 22 which is driven by rotation of the crank shaft 6.

Air, which is regulated in quantity by the throttle valve 16 and flows through the inlet passage 14, and fuel, which is injected by the fuel injection valve 18 become mixed into an air-fuel mixture which is allowed to flow into the crank chamber 4. Then the air-fuel mixture is supplied into the combustion chamber 8, ignited for combustion by the ignition plug 12 and discharged outside through a discharge passage not shown. Owing to this combustion, the piston 10 actuates the crank shaft 6. A driving force of the internal combustion engine 2 taken off through the crank shaft 6 is transmitted from the clutch mechanism (not shown), which is coupled when engine speed N exceeds a coupling engine speed CEN as shown in FIG. 5, to a driving mechanism through a transmission mechanism (for example, a belt type non-stage transmission or the like) and causes the vehicle to run.

The fuel injection valve 18 is communicated with the fuel tank 26 through the fuel supply passage 24. The fuel supply passage 24 is provided at an intermediate portion thereof with a fuel pump 28 adapted to transfer fuel under pressure and a fuel filter 30 adapted to remove dust and the like contained in the fuel. The fuel injection valve 18 is also communicated with the fuel tank 26 through a fuel pressure regulation passage 32. This fuel pressure regulation passage 32 is provided at an intermediate portion thereof with a fuel pressure regulation valve 34. In this fuel pressure regulation valve 34, fuel pressure to be transferred to the fuel injection valve 18 under pressure is regulated to a predetermined level by intake pressure of the inlet passage 14, and a surplus fuel is returned to the fuel tank 26 through the fuel pressure regulation passage 32.

The fuel injection valve 18 is connected to a control portion 38 through a resistor 36. The fuel pump 28 is connected to the control portion 38 through a pump relay 40 and is selectively connected with and cut off from a battery 52. This control portion 38 is connected with the ignition circuit 20 for detecting engine speed, a throttle opening degree sensor 42 for detecting the throttle opening degree of the throttle valve 16, a water temperature sensor 44 for detecting the temperature of cooling water of the internal combustion engine 2, an intake air temperature sensor 46 for detecting intake air temperature, and also with an atmospheric pressure sensor 48 for detecting atmospheric pressure. This atmospheric pressure sensor 48 is disposed within the control portion 38.

The control portion 38 is connected to battery 52 through a control portion relay 50 adapted to supply and cut off the supply of power to the control portion. The control portion relay 50 is connected to the battery 52 through an ignition switch 54. The control portion relay 50 is turned on/off by the ignition switch 54. The reference numeral 56 denotes a fuse for the control portion relay 50, which is disposed between the control portion relay 50 and the battery 52. The numeral 58 denotes a fuse for the ignition switch 54, which is disposed between the ignition switch 54 and the battery 52. The numeral 60 denotes a fuse for the pump relay 40, which is disposed between the pump relay 40 and the battery 52.

The control portion 38 is operated to control the action of the fuel injection valve 18 in accordance with signals input from the aforementioned sensors. In other words, it controls, by means of the basic fuel injection control, such that an amount of fuel obtained from a map of fuel amount as a function of the throttle opening degree ($\alpha$) and the engine speed (N) is injected through the fuel injection valve 18 at times other than the starting time of the internal combustion engine 2.

The control portion 38 is operated to control fuel to be injected by correcting an amount thereof, with respect to basic fuel injection control, within a predetermined period of time T after the start of the internal combustion engine by means of starting time fuel injection control. This starting time fuel injection control, as shown in FIGS. 4 through 7, comprises a low revolution basic pulse as a low revolution basis, an engine speed correction, a time correction, and an altitude correction. The low revolution basic pulse, the engine speed correction and the altitude correction are normally made in the basic fuel injection control. The controlling of coupling/decoupling of the clutch mechanism is made by the engine speed correction. The conventional correction value of this engine speed correction is preset to a constant value in an engine speed area on the increasing side from a certain engine speed as indicated by the solid line of FIG. 5.

The starting time engine speed control device includes the control portion 8 as control means adapted to control fuel to be injected by gradually increasingly correcting the amount thereof in accordance with increasing engine speed N up to the coupling engine speed CEN at the time fuel is supplied by correcting the amount thereof by means of the starting time fuel injection control.

That is, in the starting time engine speed control device comprising at least a low revolution base, an engine speed correction function and a time correction function with respect to the basic fuel injection control, the control portion 38 controls such that a corrected value produced by the engine speed correction of the starting time fuel injection control is set in such a manner as to be gradually increased as it goes toward the coupling engine speed CEN from a predetermined engine speed CVEN which is lower than the coupling engine speed CEN as shown by the broken lines in FIG. 5. Fuel is injected by the engine speed correction in which the corrected value is set in such a manner as to be gradually increased in accordance with an increasing state of the engine speed N up to the coupling engine speed CEN as shown in FIG. 5 at the time fuel is supplied by correcting the amount thereof by means of the starting time fuel injection control.

Figure 2:
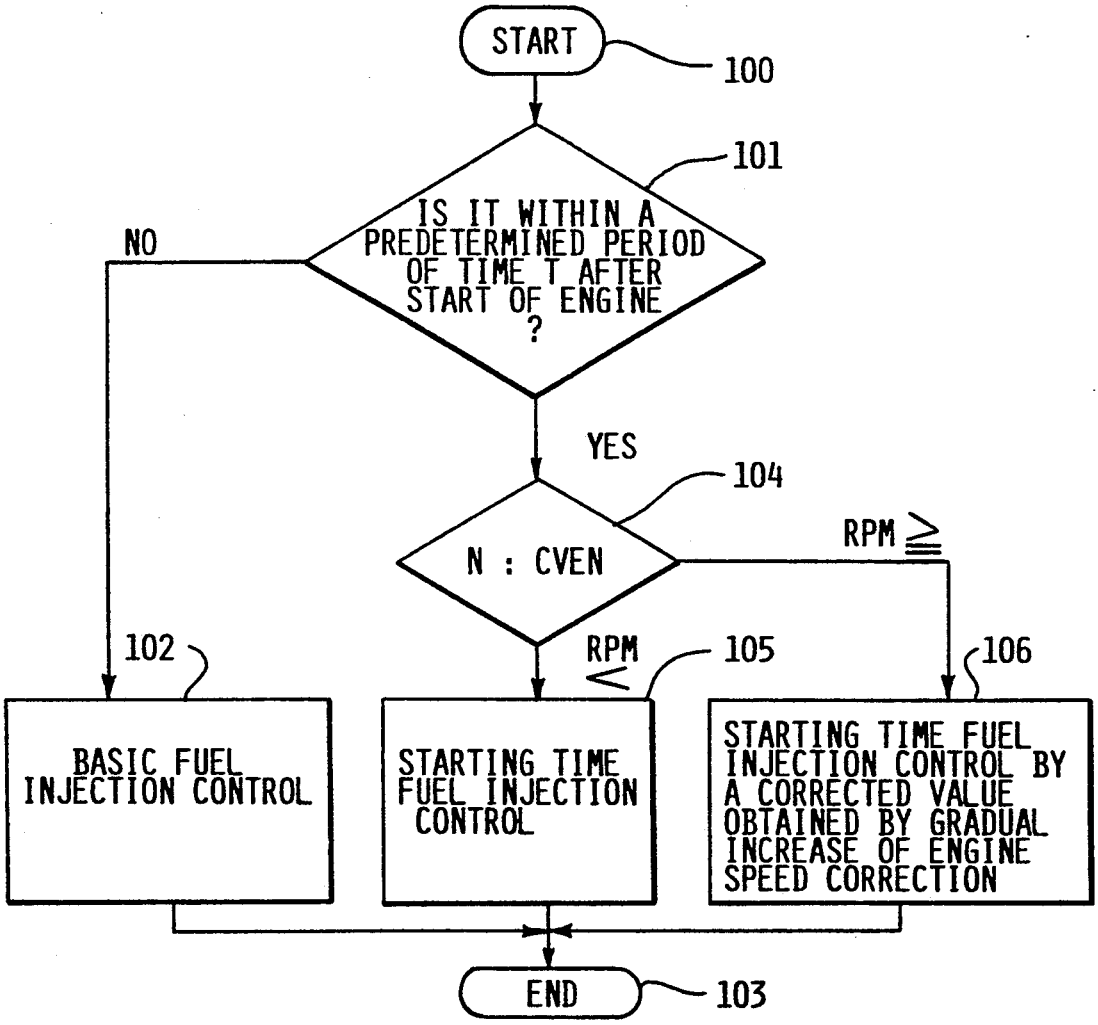
FIG. 2 is a flowchart of controlling operation.

Next, operation will be described with reference to FIG. 2.

When the control operation is started (100), the control portion 38 judges whether or not it is within the predetermined period of time T from the start of the internal combustion engine 2 (101).

If the predetermined period of time T after the start of the internal combustion engine 2 has passed (101: NO), an amount of fuel figured out from the map between the throttle opening degree ($\alpha$) and the engine speed (N) by means of the basic fuel injection control (102) is controlled to be injected by the fuel injection valve 18 and then, it goes to END (103).

If it is still within the predetermined period of time T after the start of the internal combustion engine 2 (101: YES), it is judged which is larger, the engine speed N or the predetermined engine speed CVEN which has been preset to a level lower than the coupling engine speed CEN (104).

If the engine speed N is smaller than the predetermined engine speed CVEN (104: $N<CVEN$), fuel is controlled by correcting the amount thereof by means of the starting time fuel injection control (105) comprising a low revolution basic pulse, an engine speed correction, a time correction and an altitude correction and is injected through the fuel injection valve 18, and then it goes to END (103).

If the engine speed N is equal to or higher than the predetermined engine speed CVEN (104: $N \geqq CVEN$), fuel is controlled by gradually increasingly correcting the amount thereof by means of the starting time fuel injection control (106) in which the corrected value is determined by means of gradual increase as shown by the broken lines in FIG. 5, comprising a correction of engine speed, a of time and a correction of altitude and is injected through the fuel injection valve 18, and then it goes to END (103).

In other words, if the engine speed N is equal to or higher than the predetermined engine speed CVEN when fuel is injected by correcting the amount thereof by means of the starting time fuel injection control, fuel to be injected is controlled by gradually increasingly correcting the amount thereof by the correction of engine speed in which a corrected value is determined by means of the aforementioned gradual increase in accordance with increasing engine speed N up to the coupling engine speed CEN.

If the engine speed N is lower than the predetermined engine speed CVEN, the controlling of the correction for gradually increasing the amount of fuel by the correction of engine speed, in which a corrected value is preset by means of the aforementioned gradual increase, is not made.

In this way, by letting the control portion 38 control to set the corrected value of the correction of engine speed made by the starting time fuel injection control in such a manner as to be gradually increased as it goes toward the coupling engine speed CEN from the predetermined engine speed CVEN which is lower than the coupling engine sped EN as shown by the broken lines in FIG. 5 and to inject the fuel by gradually increasingly correcting the amount thereof by the correction of engine speed in which a corrected value is determined in such a manner as to be gradually increased in accordance with increasing engine speed N up to the coupling engine speed CEN at the time the fuel is injected by correcting the amount thereof by means of the starting time fuel injection control as shown in FIG. 3, an engine output is reduced by excessively intensifying the air-fuel ratio to lower the engine speed in order to prohibit coupling of the clutch mechanism.

By virtue of the foregoing arrangement, a meaningless increase of engine can be prevented when fuel is controlled to be injected by correcting the amount thereof by means of the starting time fuel injection control with respect to the basic fuel injection control at the starting time of the internal combustion engine 2 which has a clutch mechanism which is coupled when the engine speed N exceeds the coupling engine speed CEN, and thus, coupling of the clutch mechanism can be prevented. As a result, it is possible to overcome the problem that a driving force of the internal combustion engine 2 is transmitted to the driving mechanism.

It should be evident that the control portion 38 may be implemented using a conventional microprocessor circuit.

Next, another embodiment of the invention will be described. Since a starting time engine speed control device according to this embodiment has a similar constitution as the first embodiment, the reference numerals of FIG. 1 will be used for the following description.

The control portion 38 is operated to control the action of the fuel injection valve 18 in accordance with signals input from the aforementioned sensors. In other words, it controls such that an amount of fuel to be figured out from a map between the throttle opening degree ($\alpha$) and an engine speed (N) by means of basic fuel injection control is injected through the fuel injection valve 18 at times other than the starting time of the internal combustion engine 2.

The control portion 38 is operated to control such that fuel is injected by correcting an amount thereof within a predetermined period of time T after the start of the internal combustion engine by means of a starting time fuel injection control with respect to a basic fuel injection control. This starting time fuel injection control, as shown in FIGS. 10 through 13, comprises a low revolution basic pulse as a low revolution base, an engine speed correction, a time correction, and an altitude correction. The low revolution basic pulse, the engine speed correction and the altitude correction are normally made in the basic fuel injection control. The controlling of coupling and decoupling of the clutch mechanism is made by the engine speed correction. The conventional corrected value of this engine speed correction is preset to a constant value in an engine speed area on the increasing side from a certain engine speed as indicated by the solid line of FIG. 11.

The control portion 38 is adapted to control the fuel to be injected by gradually increasingly correcting the amount thereof by means of the starting time fuel injection control in accordance with increasing engine speed up to the coupling engine speed CEN at the time fuel is injected. The control means is further able to control such that when the throttle opening degree $\alpha$ is equal to or more than a preset throttle opening degree $\alpha$ CAN and engine speed N is equal to or higher than a preset level NCAN, the mode of controlling is shifted from the starting time fuel injection control to the basic fuel injection control and the amount of fuel decided by the basic fuel injection control is injected.

Figure 9:
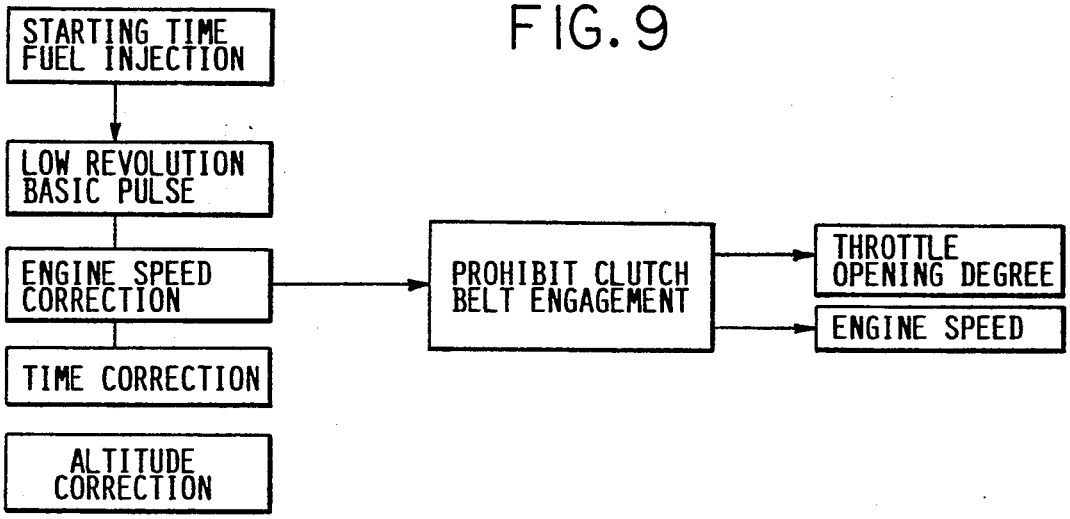
FIG. 9 is a block diagram of controlling operation of the second embodiment.
Figure 10:
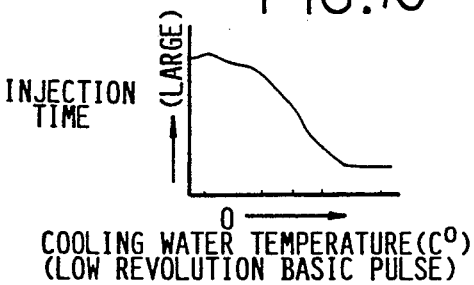
FIG. 10 is an explanatory view of a low revolution basic pulse of starting time fuel injection control in the second embodiment.
Figure 11:
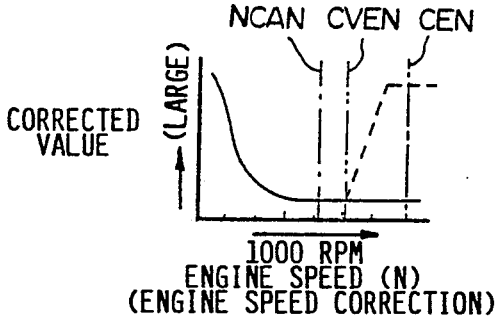
FIG. 11 is an explanatory view of engine speed correction of the starting time fuel injection control in the second embodiment.
Figure 12:
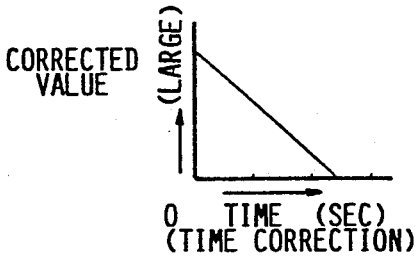
FIG. 12 is an explanatory view of the time correction of the starting time fuel injection control in the second embodiment.
Figure 13:
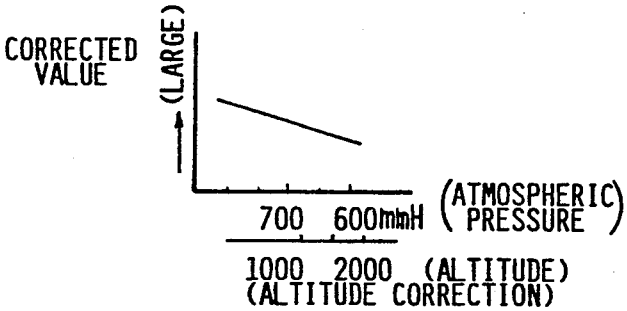
FIG. 13 is an explanatory view of an altitude correction of the starting time fuel injection control in the second embodiment.

The control portion 38 controls such that a corrected value of the engine seed correction of the starting time fuel injection control is gradually increased as it goes toward the coupling engine speed CEN from predetermined engine speed CVEN which is lower than the coupling engine speed CEN as shown by broken lines in FIG. 11, and fuel is injected by means of the engine speed correction in which the corrected value is determined in such a manner as to be gradually increased in accordance with increasing engine speed N up to the coupling engine speed CEN as shown in FIG. 9. The mode for controlling is shifted from the starting time fuel injection control to the basic fuel injection control when the throttle opening degree $\alpha$ is equal to or more than a preset throttle opening degree $\alpha$ CAN and the engine speed N is equal to or higher than a preset engine speed NCAN which is preset to a level lower than the preset engine speed CVEN, and the amount of fuel decided by the basic fuel injection control is injected.

Figure 8:
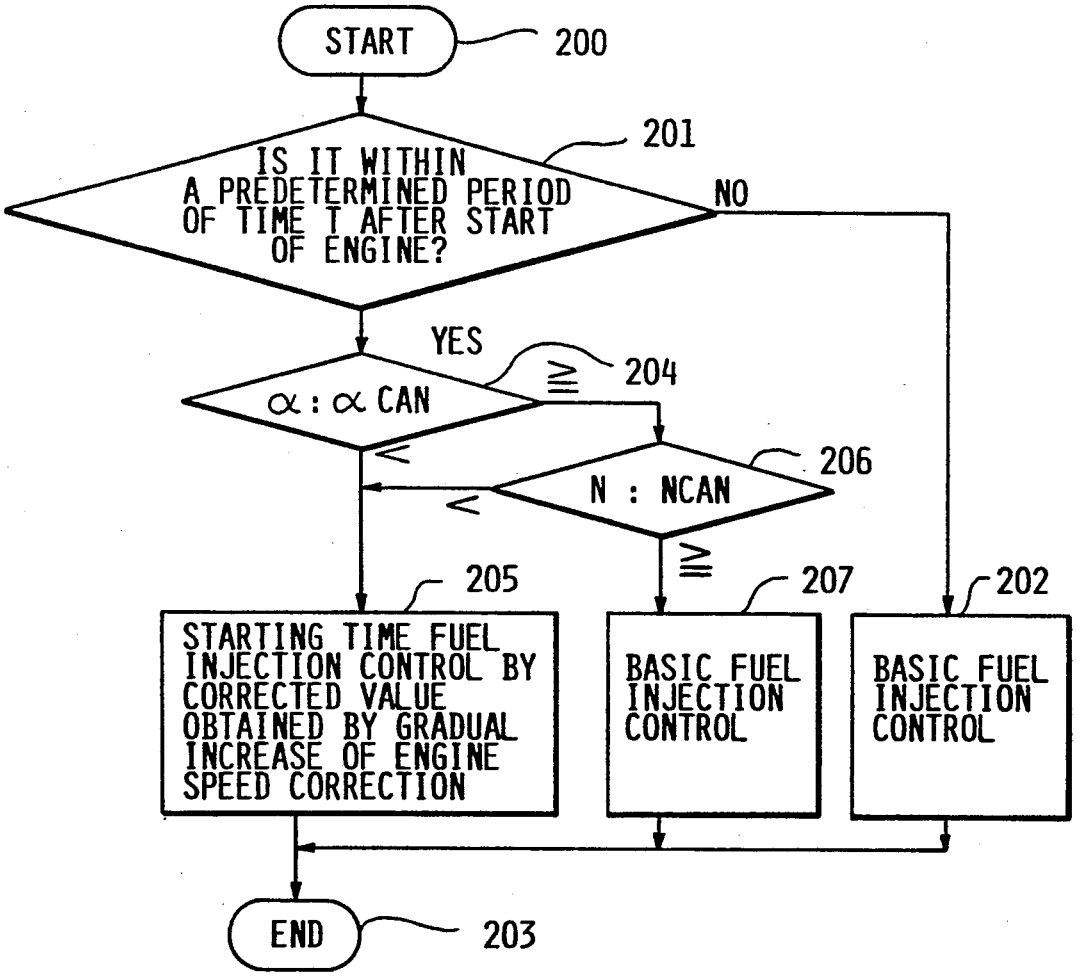
FIG. 8 is a flowchart of controlling operation according to a second embodiment of the invention.

Next, operation will be described with reference to FIG. 8.

When the control operation is started (200), the control portion 38 judges whether or not it is within the predetermined period of time T from the start of the internal combustion engine 2 (201).

If the predetermined period of time T after the start of the internal combustion engine 2 has passed (201: NO), an amount of fuel figured out from the map between the throttle opening degree ($\alpha$) and the engine speed (N) by means of the basic fuel injection control (202) is controlled to be injected through the fuel injection valve 18 and then, it goes to END (203).

If it is still within the predetermined period of time T after the start of the internal combustion engine 2 (201: YES), it is judged which is larger, the throttle opening degree $\alpha$ or the predetermined throttle opening degree $\alpha$ CAN (204).

If the throttle opening degree $\alpha$ is lower than the preset throttle opening degree $\alpha$ CAN (204: $\alpha<\alpha$ CAN), fuel is controlled (205) to be injected through the fuel injection valve 18 by correcting the amount thereof by means of the starting time fuel injection control comprising a low revolution basic pulse, an engine speed correction wherein the corrected value is set by means of gradual increase as shown by the broken lines in FIG. 11, a time correction and an altitude correction, and then it goes to END (203).

Figure 8A:
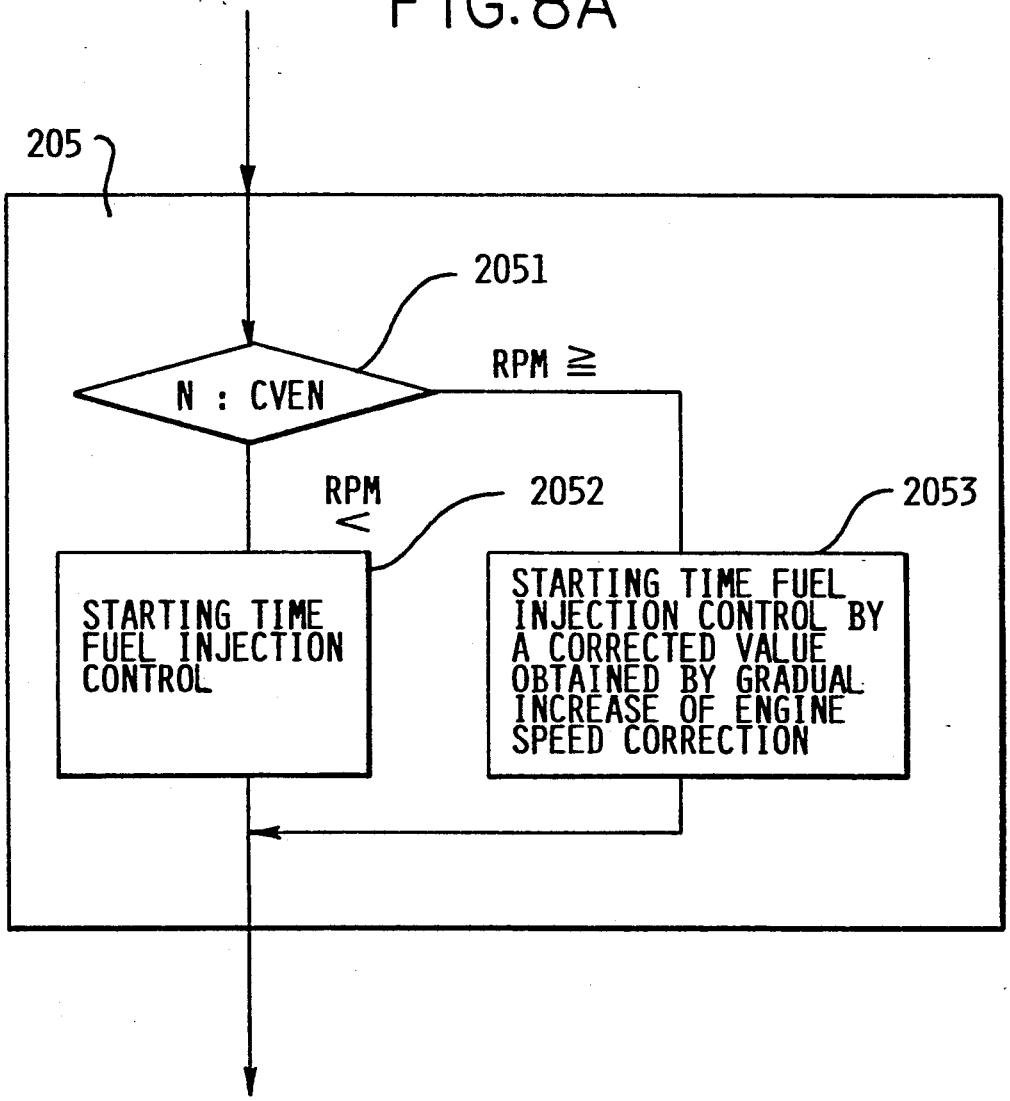
FIG. 8A shows details of a part of FIG. 8.

At that time (i.e. during execution of control block 205), if the engine speed N is lower than the predetermined engine speed CVEN (N<CVEN in block 2051 of FIG. 8A), fuel is controlled to be injected by correcting the amount thereof by means of the starting time fuel injection control comprising a low revolution basic pulse, a correction of engine speed, a correction of time, and a correction of altitude (block 2052 in FIG. 8A), and if the engine speed N is equal to or higher than the predetermined engine speed CVEN (N≧CVEN in block 2051 of FIG. 8A), fuel is controlled to be injected by gradually increasingly correcting the amount thereof (block 2053 in FIG. 8A) as mentioned previously.

In this way, by controlling to set the corrected value of the correction, of engine speed of the starting time fuel injection control in such a manner as to be gradually increased as engine speed goes toward the coupling engine speed CEN from the predetermined engine speed CVEN which is lower than the coupling engine speed CEN as shown by the broken lines in FIG. 11 and to inject fuel by gradually increasingly correcting the amount thereof by means of the correction of engine speed in which a corrected value is set in such a manner as to be gradually increased in accordance with increasing engine speed, the engine output is reduced by excessively intensifying the air-fuel ratio so that the engine speed is lowered to prohibit coupling of the clutch mechanism.

By virtue of the foregoing arrangement, a meaningless increase of engine seed can be prevented when fuel is controlled to be injected by correcting the amount thereof by means of the starting time fuel injection control with respect to the basic fuel injection control, and thus, coupling of the clutch mechanism can be prevented. As a result, it is possible to overcome the problem that a driving force of the internal combustion engine 2 is transmitted to the driving mechanism.

If the throttle opening degree $\alpha$ is equal to or more than the preset throttle opening degree $\alpha$ CAN (204: $\alpha \geqq \alpha$CAN), it is judged which is larger, the engine speed N or the preset engine speed NCAN which is preset to a level lower than the predetermined engine speed CVEN (206).

If the engine speed N is lower than the preset engine speed NCAN (206: N<NCAN), the above-mentioned step 205 is executed, and then it goes to END (203).

On the other hand, if the engine speed N is equal to or higher than the preset engine speed NCAN (206: N≧NCAN), the amount of fuel decided by the basic fuel injection control is controlled to be injected through the fuel injection valve 18 (207), and then it goes to END (203).

That is, when the vehicle starts driving immediately after the start of the internal combustion engine 2, if the engine speed N is increased to a level equal to or higher than the preset engine speed NCAN which is preset to a level lower than the predetermined engine speed CVEN by opening the throttle valve 16 of the internal combustion engine 2 to the extent equal to or more than the preset throttle opening degree $\alpha$ CAN, the control portion 38 controls such that the mode of controlling is shifted from the starting time fuel injection control to the basic fuel injection control and the amount of fuel decided by this basic fuel injection control is injected, and the prohibition of coupling of the clutch mechanism is removed by obtaining an engine output required for the driving of a vehicle by a proper air-fuel ratio.

By virtue of the foregoing arrangement, there can be obviated an awkwardness of the driving of a vehicle due to improper air-fuel ratio when the vehicle starts driving immediately after the start of the internal combustion engine 2, by making the excessively intensified air-fuel ratio caused by the engine speed correction of the starting time fuel injection control to a proper air-fuel ratio by shifting the mode of controlling to the basic fuel injection control.

As apparent from the foregoing description, according to the invention by letting the control means control fuel to be injected in such a manner as to increasingly correct an amount thereof by means of a starting time fuel injection control in accordance with an increasing state of engine speed up to a coupling engine speed when fuel is injected, an air-fuel ratio is intensified to reduce an engine output and to lower the engine speed thereby prohibiting coupling of a clutch mechanism.

Accordingly, a meaningless increase of engine speed can be prevented when fuel is controlled to be injected by correcting the amount thereof by means of the starting time fuel injection control with respect to the basic fuel injection control, and thus, coupling of the clutch mechanism can be prevented. As a result, there can be overcome the problem that a driving force of the internal combustion engine is transmitted to the driving mechanism.

Similarly, according to the invention, by letting the control means control such that when the throttle valve is opened to the extent equal to or more than a preset throttle opening degree to increase the engine speed to a level equal to or higher than a preset engine speed so that the vehicle can start driving immediately after the start of internal combustion engine, the mode of controlling is shifted from the starting time fuel injection control to the basic fuel injection control and there can be obtained an engine output required for a driving of the vehicle by a proper air-fuel ratio, by injecting the amount of fuel decided by this basic fuel injection control.

Accordingly, there can be obviated an awkwardness of the driving of a vehicle due to improper air-fuel ratio when the vehicle starts driving immediately after the start of the internal combustion engine which is mounted on the vehicle and which has a clutch mechanism which is coupled when the engine speed exceeds a coupling engine speed.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A starting time engine speed control device for controlling fuel to be injected by correcting an amount thereof within a predetermined period of time after the start of an internal combustion engine by means of a starting time fuel injection control with respect to a basic fuel injection control, the engine being mounted on a vehicle and having a clutch mechanism which is coupled when the engine speed exceeds a coupling engine speed, wherein said starting time engine speed control device includes control means adapted to control the fuel to be injected by gradually increasingly correcting the amount thereof by means of said starting time fuel injection control in accordance with increasing engine speed up to said coupling engine speed at the time fuel is injected.

2. A starting time engine speed control device for controlling fuel to be injected by correcting an amount thereof within a predetermined period of time after the start of an internal combustion engine by means of a starting time fuel injection control with respect to a basic fuel injection control, the engine being mounted on a vehicle and having a clutch mechanism which is coupled when the engine speed exceeds a coupling engine speed, wherein said starting time engine speed control includes control means adapted to control the fuel to be injected by gradually increasingly correcting the amount thereof by means of said starting time fuel injection control in accordance with increasing engine speed up to said coupling engine speed at the time fuel is injected, said control means being further provided with means for controlling such that when a throttle opening degree is equal to or more than a preset throttle opening degree and engine speed is equal to or higher than a preset level, the mode of controlling is shifted from said starting time fuel injection control to said basic fuel injection control so that said amount of fuel is decided by said basic fuel injection control.

* * * * *